United States Patent [19]

Schultheis

[11] 4,373,854

[45] Feb. 15, 1983

[54] WARP BEAM INSERTION CARRIAGE

[75] Inventor: Hans-Werner Schultheis, Kunzell, Fed. Rep. of Germany

[73] Assignee: Hubtex Maschinenbau GmbH, Petersberg, Fed. Rep. of Germany

[21] Appl. No.: 183,742

[22] Filed: Sep. 3, 1980

[30] Foreign Application Priority Data

Sep. 4, 1979 [DE] Fed. Rep. of Germany ..... 2935624

[51] Int. Cl.[3] ..... B60P 1/20

[52] U.S. Cl. ..... 414/742; 280/763; 414/911

[58] Field of Search ..... 414/458, 459, 546, 547, 414/549, 680, 684, 728, 742, 911; 212/189; 280/763, 766

[56] References Cited

U.S. PATENT DOCUMENTS

| | | | |
|---|---|---|---|
| 2,911,118 | 11/1959 | Tapp | 414/549 |
| 3,468,439 | 9/1969 | Olitsky et al. | 414/547 X |
| 3,887,095 | 6/1975 | Suzuki | 414/680 |
| 4,273,501 | 6/1981 | Terry | 414/680 |

FOREIGN PATENT DOCUMENTS

| | | | |
|---|---|---|---|
| 1024433 | 2/1958 | Fed. Rep. of Germany . | |
| 1073956 | 1/1960 | Fed. Rep. of Germany | 414/680 |
| 1943395 | 3/1966 | Fed. Rep. of Germany . | |
| 2524480 | 12/1976 | Fed. Rep. of Germany . | |

OTHER PUBLICATIONS

*Melliand Textilberichte* Nov. 1978, p. 880.

*Primary Examiner*—Robert G. Sheridan
*Attorney, Agent, or Firm*—Schwartz, Jeffery, Schwaab, Mack, Blumenthal & Koch

[57] ABSTRACT

A carriage for inserting warp beams into a weaving machine includes a frame with rollers thereon for allowing movement of the carriage with respect to a floor or other support surface. The carriage includes support arms having front ends for engagement with the journal of the warp beam for raising and lowering the warp beam as needed. The front ends of the support arm may be displaced with respect to the frame along a path which is transverse to the axis of the warp beam. It therefore becomes unnecessary, when inserting a warp beam into a weaving machine, to move the carriage as a whole transversely into the weaving machine to deposit the warp beam in the correct location on holders in the weaving machine.

8 Claims, 6 Drawing Figures

FIG. 3
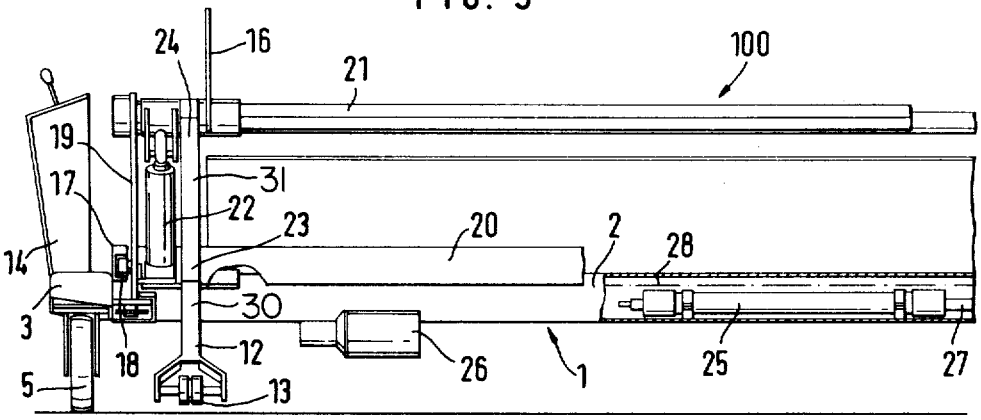
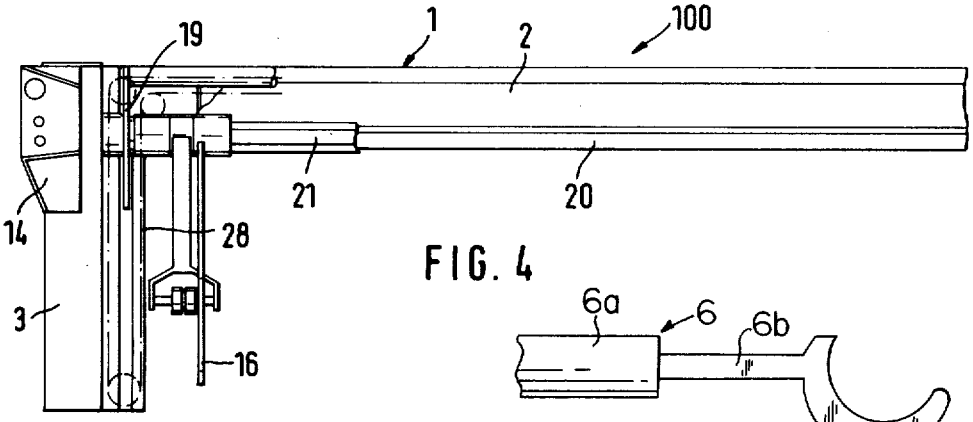
FIG. 4
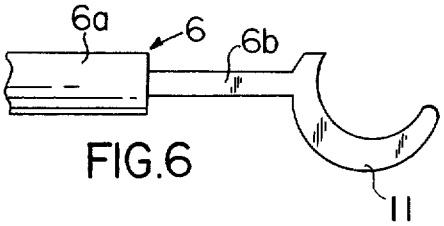
FIG.6
FIG. 5
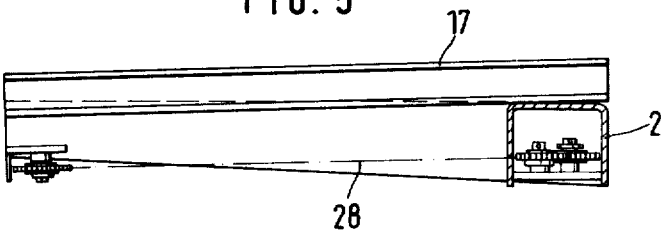

WARP BEAM INSERTION CARRIAGE

BACKGROUND

1. Field of the Invention

The invention concerns a carriage of the type used for inserting warp beams into a weaving machine.

2. Description of the Prior Art

A warp beam insertion carriage of this kind is known from German Auslegeschrift No. 1 024 433. It includes a frame which consists of a longitudinal beam and two transverse beams arranged at the ends of the longitudinal beam and made of tubes, so that the result is a rectangular, U-shaped layout, open on one side. A rotating, polygonal shaft is provided in a spaced relationship above the frame on suitable bearings. This shaft extends alongside the longitudinal beam and carries support arms projecting outwardly toward the open side of the frame. The support arms are equipped with recesses on their front ends to accept the journals of the warp beam or beams. The polygonal shaft may be rotated by means of a hydraulic cylinder acting through a lever, and the warp beam may be lifted in this manner.

The present invention concerns not only carriages having this form of embodiment with pivoting support arms, but also carriages having forms of embodiment with bracket-like support arms, generally such as those represented in German Gebrauchsmuster No. 19 43 395.

It is known that warp beam inserting carriages are moved, together with the warp beams, between the rows of weaving machines. This is done manually or by means of a suitable transport device. The carriages are aligned in front of the weaving machine to be charged in the transverse directions of the weaving machines. It has been necessary heretofore to subsequently insert each warp beam inserting carriage to a certain extent in the transverse direction into the weaving machine, so that the warp beam which rests on the support arms can be placed in the warp direction in the correct location onto the corresponding holders in the weaving machine.

It has been necessary to effect this additional displacement manually, because of the narrowness of the aisles between the weaving machines. In view of the weight of the inserting carriage loaded with the warp beam and the need of rotating the guide rollers in place, this additional manual displacement has proved to be difficult operation.

SUMMARY

It is an object of the invention to provide a warp beam inserting carriage of the type described in which this last displacement of the warp beam inserting carriage in the transverse direction into the weaving machine is eliminated.

The object of the invention is attained by providing a carriage for inserting warp beams into a weaving machine and for effecting movement of the warp beams with respect to a generally horizontal support surface, which carriage will now be briefly described. It is to be noted that the warp beam has an axis extending from end-to-end thereof. The warp beam also has a journal extending from the ends thereof. The carriage includes a frame, one side of which is for facing the weaving machine, the other side of which is for facing away therefrom. There are guide rollers on the frame, the guide rollers supporting the frame on the support surface, such as a floor. This permits movement of the frame relative to the support surface. There are a plurality of support arms coupled with the frame for supporting the warp beam. The support arms have front ends for engagement with the journal of the warp beam. The front ends of the support arms are adapted to be raised or lowered with respect to the horizontal support surface.

There is also means for displacing the front ends of the support arms with respect to the frame in a displacement path which is transverse to the axis of the warp beam and in a forward direction. The forward direction extends generally in a direction from the other side of the frame towards the one side of the frame. Both the displacement path and the forward direction as just mentioned will be generally in a horizontal plane, but, particularly in the preferred embodiment, the plane of the displacement path and of the forward direction may be disposed at a slight incline from the horizontal, the incline being downward in the forward direction.

The object of the invention is attained by the device of the present invention in that it is no longer necessary to insert the entire warp beam insertion carriage in the weaving machine. Rather, the carriage may come to a stop in front of the weaving machine, while the front ends of the support arms are run out together with the warp beam. The warp beam is then deposited in the weaving machine. The energy wasting shifting of the warp beam insertion carriage in the transverse direction and naturally its return in the opposite direction, are thus avoided. The warp beam insertion carriage may then continue its travel in its original direction.

The invention may be embodied in a first form of embodiment in which the support arms are fixed against horizontal movement with respect to the frame and in which the displacing means includes means for effecting telescopic extension of the support arms to, in turn, effect generally horizontal movement of the front ends of the support arms with respect to the frame.

In this particular embodiment, the bearing support of the support arms with respect to the frame remains unchanged. The support arms themselves are extended in order to project laterally past the frame.

In another, preferred form of embodiment the support arms may be bearingly supported on a slide that is displaceable transversely to the warp beam. In particular, the displacing means includes a slide which is mounted on the frame for displacement with respect thereto in the displacement path, and the support arms are mounted on the slide.

In this preferred embodiment, the entire arrangement of the support arms, with the bearing and lifting mechanism, is displaced laterally with respect to the frame, on the slide.

As the result of the extension of the support arms with the warp beam over the frame, the center of gravity is shifted, so that under certain conditions the great weight of the warp beam may cause the warp beam inserting carriage to tilt over.

In order to prevent this, a support structure is provided. It extends past the plan surface of the warp beam insertion carriage and provides additional support for the latter in the extended position of the support arms. In particular, the front ends of the support arms are movable, by the displacing means, from a retracted position with respect to the frame to an outermost extended position with respect thereto. This movement from the retracted position to the extended position is in the forward direction. The carriage includes supports coupled with the frame and movable with the support arms in a path generally parallel to the displacement path. The supports are disposed vertically below the front ends of the support arms and are in engagement with the support surface when the front ends of the support arms are in their outermost extended position.

In order that the supports may be applied to the floor in the correct position, they have a particular form. That is, the supports are formed by jibs extending from the frame generally in the forward direction but at a downward incline with respect thereto. The carriage includes a guide rail on the frame for guiding the movement of the jibs. The guide rail extends in a forward direction at a slight downward incline with respect to the horizontal. Thus, while the downward inclination of the jibs is considerable so that the jibs are engagable with the floor or other support surface, the downward incline of the guide rails is slight.

Because the supports and the slide are mounted in a guide rail extending at an incline in the downward direction, the supports are automatically applied when needed, i.e. with the slide in the laterally displaced outermost position. In this regard, the supports in the form of jibs are fixedly connected with the slide, and the slide, in turn, is guided on the guide rails.

The invention may be embodied in the form of a carriage according to German Auslegeschrift No. 1 024 433. In particular, the carriage includes means for effecting pivoting of the support arms so that their front ends move in generally upward and downward directions. The pivoting means includes a rotatable shaft above the frame in spaced relation thereto and extending in generally the same direction as the axis of the warp beam. The shaft is bearingly supported in the slide and displaceable along with the slide with respect to the frame.

An advantageous layout for the supports involves a construction in which the supports include two segments disposed at angles to one another and joined at a vertex. Thus each support has an angulated shape. Each support has ends, one of which faces and is adjacent to the support surface, the other of which is remote therefrom. Each support is secured to the slide in the region of the apex of the support. Each support also is secured at the remote end thereof to the rotatable shaft in a manner such as to permit rotation of the shaft with respect to the support. The drive of the slide (and of the supports that preferably move with the slide) have a special design. In particular, the frame includes a longitudinal beam having ends and a pair of transverse beams joined with the ends of the longitudinal beams so that the frame has a generally U-shaped configuration. The slide is driven in the displacement direction by driving means. The driving means includes a flexible tension element, such as a chain, disposed in the longitudinal beam of the frame and a piston and cylinder unit to which the flexible tension unit is connected. The flexible element is diverted in its direction so as to also extend into the transverse beams. The flexible element is connected with the slide in the area of the transverse beams to effect the displacement of the slide with respect to the frame.

It is advisable to provide rollers at the end of the supports facing the ground, the floor, or other support surface to prevent jamming on the floor of the supports during their movement. Otherwise, the interaction between the supports and floor board involve heavy contact, leading to a reaction on the warp beam insertion carriage, i.e. a shift of the latter away from the weaving machine.

BRIEF DESCRIPTION OF THE DRAWING

In the drawing, exemplary embodiments of the invention are represented.

FIG. 3 shows a front view of a warp beam insertion carriage according to FIG. 2 at a somewhat reduced scale;

FIG. 4 shows a top or plan view of a warp beam insertion carriage according to FIG. 3;

FIG. 5 shows a detail of the guide rail;

FIG. 6 shows a detail of telescoping support arms.

DETAILED DESCRIPTION

Figure 1:
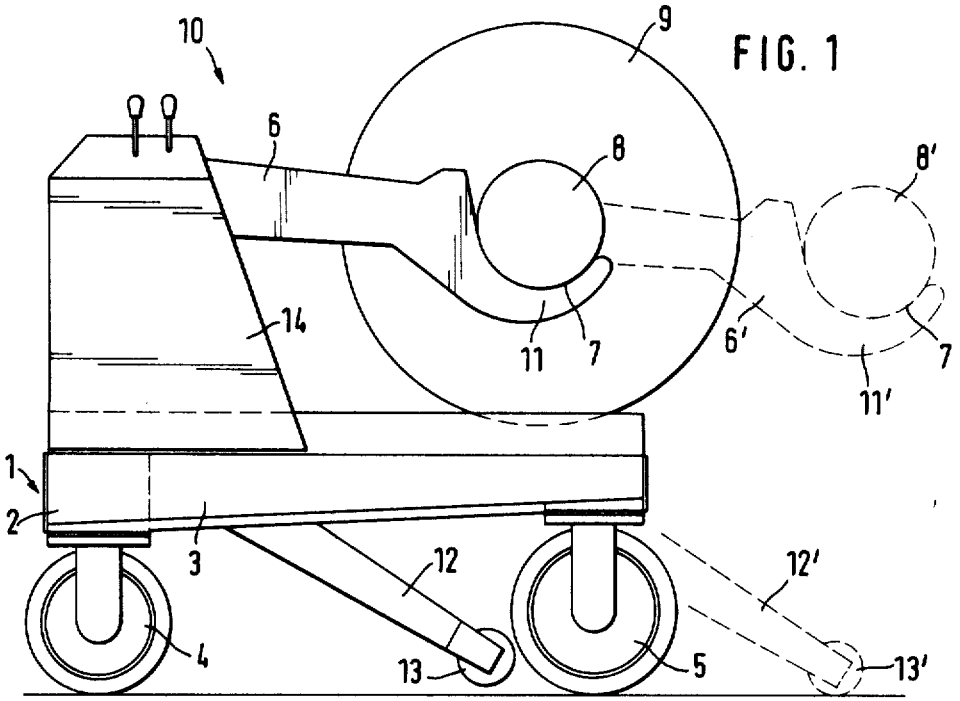
FIG. 1 shows a side elevation of a warp beam insertion carriage according to the invention.

The warp beam insertion carriage designated by 10 (FIG. 1) and 100 (FIGS. 2–5), respectively, has a frame comprising a longitudinal beam 2 and two transverse beams 3 connected at their ends with beam 2. Thus, in plan, the frame has the form of a very wide U, which is open in FIGS. 1 and 2 to the right and in FIG. 4 in the downward direction. Guide rollers 4, 5 are attached to the four corners of the frame 1, so that the warp beam insertion carriage may be moved in any direction.

In the upper left area (as per FIG. 1) of the warp beam insertion carriage 10, a plurality of support arms 6 are mounted on the inside of the two transverse beams 3 for pivotal movement in the upward and downward directions. Support arms 6 have a recess 7 at their front end 11 to receive the journal 8 of a warp beam 9. The journal 8 projects slightly outwardly of warp beam 9 in the axial direction. The warp beam insertion carriage is moved around a warp beam 9 which rests on the floor, so that the warp beam 9 is located between the transverse beams 3. The support arms 6 reach under the journal 8 and lift the warp beam 9 into the position indicated in FIG. 1, while being rotated upward. In this position, the warp beam may be moved on the carriage 10 and inserted into the weaving machine.

The principle of the invention is illustrated in FIG. 1. The front end 11 of the support arms 6 may be displaced in the horizontal direction according to FIG. 1 to the right, i.e. toward the open side of the frame 1, into the position 11', shown by the broken line. The warp beam 9 may thereby be moved beyond the outline of the warp beam insertion carriage 10 and inserted in the weaving machine, without having to move the carriage in its entirety. In this regard it is to be noted that the carriage originally would have been run in the direction perpendicular to the plane of the drawing, into the aisle between the weaving machines.

As a result of the displacement of the front end 11 of the support arms 6 into the position 11', the center of gravity of the entire assembly may be shifted too far to the right by the great weight of the warp beam 9, so that the warp beam 10 tilts to the right around the guide rollers 5. Supports 12 are provided to prevent this. These supports are inactivated when the support arm is retracted in the manner shown in FIG. 1 at which time they are located slightly above the ground. Upon the extension of the support arm 6, the supports occupy the position 12' shown by the broken line in which they rest on the ground and act to prevent tilting, as they are located approximately under the journal 8. Rollers 13 are attached to the front ends of the supports 12, which act to facilitate the extension of the supports 12 into the position 12' by reducing the recoil or reaction tendency which otherwise would stem from the extension and floor engaging action of the supports 12. That is, the rollers reduce the tendency of the warp beam insertion carriage 10 as a whole to move to the left as viewed in FIG. 1.

The support arms 6 are raised hydraulically by means of a battery operated pump, the control of which is effected by means of a console 14 equipped with the appropriate control elements.

The extension of the support arms 6 into the position 6' shown in FIG. 1 may be effected by designing the support arms 6 so that they may be extended in one or several stages in the manner of a telescope. A telescopic arm is shown in FIG. 6.

Another form of embodiment 100 of the warp beam insertion carriage is shown in FIGS. 2 to 5. Therein, the support arms 16 are unchanged (but are not telescoping arms) and are moved, together with their bearing support, on a slide with respect to the frame 1. As viewed in FIG. 2 the movement is from left to right, so that the support arms arrive in the position 16' indicated by a broken line.

The support arms 16 have a front end 31 with a recess 29 for the journal 8 of the warp beam.

Figure 2:
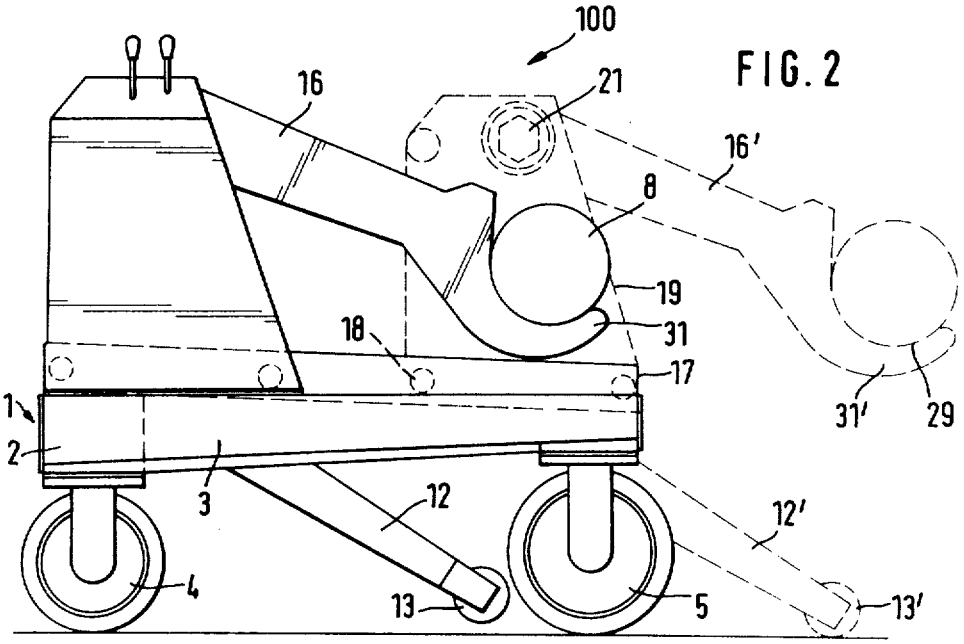
FIG. 2 shows a front elevation of a warp beam insertion carriage with a displaceable slide.

The warp beam insertion carriage 100 is provided with, in the upper area of the transverse beams 3, U-shaped guide rails 17 mounted on the frame 1. As seen in FIG. 2 guide rails 17 are inclined slightly downwardly to the right. Rollers 18 run in guide rails 17. The rollers 18 are retained by lateral sides 19, which together with a rear transverse beam 20, form a slide, capable of being displaced in the guide rails in the transverse direction.

In the upper area of the lateral sides 19, a hexagonal shaft 21 (i.e. a shaft having a transverse cross section of hexagonal configuration), is bearingly and rotatingly supported. Shaft 21 may be pivotally moved about its axis by means of a lifting cylinder 22. The support arms 16 are seated rotatingly in appropriate sleeves on the hexagonal shaft. Supports arms 16 may be raised and lowered by actuating the hydraulic cylinder 22.

The support arms 16 may be shifted along the hexagonal shaft 21 to adapt them to different lengths of warp beams.

The supports 12 have the form of angularly disposed segments 30, 31. At the vertex 23 between segments they are secured to the slide. At their upper ends the supports surround at 24 the hexagonal shaft 21 so that rotation of the hexagonal shaft 21 with respect to the supports 12 remains possible. When the slide is advanced into the position indicated by the broken line shown in FIG. 2, it moves along the inclined guide rail 17 slightly in the downward direction. Thus, the supports 12 connected with the slide contact the ground in the manner shown in FIG. 2.

The motion of the slide 18, 19, 20, together with the rotation of the hexagonal shaft 21, is effected hydraulically. In the longitudinal beams 2 of the frame 1 of the warp beam transport carriage 100, a hydraulic cylinder 25 with an adequately long stroke in the longitudinal direction is arranged. Cylinder 25, together with the hydraulic cylinder 22, is actuated by the pump 26. A chain 28 is connected with the piston rod 27 of the hydraulic cylinder 25. Chain 28 passes through the longitudinal beam 2 and is deflected by sprockets into the transverse beams 3 in the manner shown in FIG. 4. The slide 19, 20 is connected with the chain 28 in the area of the two transverse beams 3. Control is effected by means of the console 14.

What is claimed is:

1. A carriage for inserting warp beams into a weaving machine and for effecting movement of a warp beam with respect to a generally horizontal support surface, the warp beam having an axis extending from end-to-end of the warp beam, the warp beam also having a journal extending from the ends thereof, the carriage comprising:

a frame, one side of which is for facing the weaving machine, the other side of which is for facing away therefrom;

guide rollers on said frame, said guide rollers supporting said frame on the support surface to permit movement of said frame relative to the support surface;

a plurality of support arms coupled with said frame for supporting the warp beam, said support arms having front ends for engagement with the journal of the warp beam; said front ends of said support arms being adapted to be raised or lowered with respect to the horizontal support surface;

means for displacing said front ends of said support arms with respect to said frame in a displacement path which is transverse to the axis of the warp beam and in a forward direction, said forward direction running in a direction generally from said other side toward said one side of said frame;

said front ends of said support arms being movable, by said displacing means, from a retracted position with respect to said frame to an outermost extended position with respect thereto, such movement from said retracted position to said extended position being in said forward direction;

supports coupled with said frame and movable with said support arms in a path generally parallel to said displacement path, said supports being disposed vertically below said front ends of said support arms and being in engagement with the support surface when said front ends of said support arms are in said outermost extended position;

said supports being formed by jibs extending from said frame generally in said forward direction but at a downward incline with respect thereto; and a guide rail on said frame for guiding the movement of said jibs, said guide rail extending in a forward direction at a downward incline with respect to the horizontal.

2. A carriage as defined in claim 1 wherein said support arms are fixed against horizontal movement with respect to said frame and wherein said displacing means includes means for effecting telescopic extension of said support arms to, in turn, effect generally horizontal movement of said front ends of said support arms with respect to said frame.

3. A carriage as defined in claim 1 wherein said displacing means includes a slide which is mounted on said frame for displacement with respect thereto in said displacement path, said support arms being mounted on said slide.

4. A carriage as defined in claim 1 wherein said displacing means includes a slide which is mounted on said frame for displacement with respect thereto generally in said displacement direction, said support arms being mounted on said slide; wherein said front ends of said support arms are movable by said displacing means from a retracted position with respect to said frame to an outermost extended position with respect thereto, such movement from said retracted to said extended positions being generally in said forward direction; and including supports coupled with said frame and movable with said support arms in a path generally parallel to the displacement path, said supports being disposed vertically below said front ends of said support arms and being in engagement with the support surface when said front ends of said support arms are in said outermost extended position; wherein said supports are formed by jibs extending from said frame generally in said forward direction but at a downward incline with respect thereto, and including a guide rail on said frame for guiding the movement of said jibs, said guide rail extending in said forward direction at a downward incline with respect to the horizontal; and wherein said supports are fixedly connected with said slide and said slide is guided in said guide rail.

5. A carriage as defined in claim 4 including means for effecting pivoting of said support arms so that their front ends move in generally upward and downward directions, said pivoting means including a rotatable shaft located above said frame in spaced relation thereto and extending in generally the same direction as the axis of the warp beam, said shaft being bearingly supported in said slide and displaceable along with said slide with respect to said frame.

6. A carriage as defined in claim 5 wherein each of said supports includes two segments disposed at angles to one another and joined at a vertex so that each support has an angulated shape, each support having ends, one of which faces and is adjacent to the support surface, the other of which is remote therefrom, each support being secured to said slide in the region of said apex of the support, each support also being secured at said remote end thereof to said rotatable shaft in a manner such as to permit rotation of said shaft with respect to the support.

7. A carriage as defined in claim 4 wherein said frame includes a longitudinal beam having ends and a pair of transverse beams joined with said ends of said longitudinal beam so that said frame has a generally U-shaped configuration; and wherein said slide is driven in the displacement direction by driving means, said driving means including a flexible tension element disposed in said longitudinal beam of said frame and a piston and cylinder unit to which said flexible tension unit is connected, said flexible element being diverted in its direction so as to also extend into said transverse beams and being connected with said slide in the area of said transverse beams to effect the displacement of said slide with respect to said frame.

8. A carriage as defined in claims 2, 3, or 4 wherein each of said supports has an end which faces the support surface, and wherein each support is provided with a roller at said end facing the support surface.

* * * * *